US010026526B2

(12) United States Patent
Mieno et al.

(10) Patent No.: US 10,026,526 B2
(45) Date of Patent: Jul. 17, 2018

(54) HIGH-FREQUENCY WIRE AND HIGH-FREQUENCY COIL

(71) Applicant: FUJIKURA LTD., Tokyo (JP)

(72) Inventors: Satoshi Mieno, Tokyo (JP); Chihiro Kamidaki, Sakura (JP); Yasunobu Hori, Sakura (JP)

(73) Assignee: FUJIKURA LTD., Koto-ku, Tokyo (JP)

( * ) Notice: Subject to any disclaimer, the term of this patent is extended or adjusted under 35 U.S.C. 154(b) by 0 days.

(21) Appl. No.: 15/024,302

(22) PCT Filed: Sep. 22, 2014

(86) PCT No.: PCT/JP2014/075104
§ 371 (c)(1),
(2) Date: Mar. 23, 2016

(87) PCT Pub. No.: WO2015/046153
PCT Pub. Date: Apr. 2, 2015

(65) Prior Publication Data

US 2016/0233009 A1 Aug. 11, 2016

(30) Foreign Application Priority Data

Sep. 25, 2013 (JP) ..... 2013-198987

(51) Int. Cl.
*H01B 5/08* (2006.01)
*H01B 7/30* (2006.01)
(Continued)

(52) U.S. Cl.
CPC ..... *H01B 7/30* (2013.01); *H01B 1/023* (2013.01); *H01B 3/008* (2013.01); *H01B 7/0009* (2013.01);
(Continued)

(58) Field of Classification Search
CPC ..... H01B 5/08
(Continued)

(56) References Cited

U.S. PATENT DOCUMENTS 2,732,422 A * 1/1956 Rapp ..... H01B 7/1895 174/116
3,594,491 A * 7/1971 Zeidlhack ..... H01B 11/1808 174/102 R
(Continued)

FOREIGN PATENT DOCUMENTS

CN 101065010 A 10/2007
CN 101669180 A 3/2010
(Continued)

OTHER PUBLICATIONS

Communication dated May 24, 2016, from the Japanese Patent Office in counterpart application No. 2013-198987.
(Continued)

*Primary Examiner* — Chau N Nguyen
(74) *Attorney, Agent, or Firm* — Sughrue Mion, PLLC

(57) ABSTRACT

A high-frequency wire includes: a central conductor that is formed from aluminum or an aluminum alloy; and a magnetic layer that has a fibrous structure formed along a longitudinal direction of the central conductor and covers the central conductor.

11 Claims, 14 Drawing Sheets

(51) Int. Cl.

| | |
|---|---|
| ***H01B 1/02*** | (2006.01) |
| ***H01B 7/00*** | (2006.01) |
| ***H01B 3/00*** | (2006.01) |
| ***H01F 27/28*** | (2006.01) |
| ***H01B 13/00*** | (2006.01) |

(52) U.S. Cl.
CPC ..... *H01B 13/0036* (2013.01); *H01F 27/2823* (2013.01)

(58) Field of Classification Search
USPC ..... 174/126.2, 128.2
See application file for complete search history.

(56) References Cited

U.S. PATENT DOCUMENTS

| | | | | |
|---|---|---|---|---|
| 5,525,988 | A * | 6/1996 | Perkins | H01Q 17/001 342/1 |
| 6,472,603 | B1 * | 10/2002 | Inoue | H01B 11/1008 174/121 R |
| 2008/0011511 | A1 | 1/2008 | Niino | |
| 2010/0068512 | A1 | 3/2010 | Imaoka et al. | |
| 2013/0014973 | A1 | 1/2013 | Shinmoto et al. | |

FOREIGN PATENT DOCUMENTS

| | | | |
|---|---|---|---|
| CN | 102171771 | A | 8/2011 |
| CN | 102822907 | A | 12/2012 |
| EP | 2 551 856 | A1 | 1/2013 |
| EP | 2 760 031 | A1 | 7/2014 |
| JP | 03-062410 | A | 3/1991 |
| JP | 3-62410 | A | 3/1991 |
| JP | 2004-139832 | A | 5/2004 |
| JP | 2005-108654 | A | 4/2005 |
| JP | 2007-59150 | A | 3/2007 |
| JP | 2009-129550 | A | 6/2009 |
| JP | 2009-277396 | A | 11/2009 |
| JP | 2010-177075 | A | 8/2010 |
| JP | 2012-97321 | * | 5/2012 |
| JP | 2012195227 | A | 10/2012 |
| JP | 2013149460 | A | 8/2013 |
| WO | 2011/118054 | A1 | 9/2011 |
| WO | 2013/042671 | A1 | 3/2013 |

OTHER PUBLICATIONS

Ma, Yong-qing et al., "Bonding mechanism, microstructure and properties of the bimetallic wires by clad-drawing", Journal of Functional Materials, Dec. 31, 2009, vol. 40, pp. 94-97.

Qiu, Cong-zhang et al., "Research Analysis of Production Situation and Development of Stainless Steel and FeCrAl Fibre", Metal Materials and Metallurgy Engineering, Mar. 31, 2007, vol. 35, No. 2, pp. 14-18.

Communication dated Oct. 8, 2016 from the State Intellectual Property Office of the P.R.C. in counterpart Application No. 201480052556.3.

Communication dated Apr. 3, 2017, from the European Patent Office in counterpart European Application No. 14847523.9.

Tsutomu Mizuno, et al., "Reduction of eddy current loss in magnetoplated wire", Compel—The International Journal for Computation and Mathematics in Electrical and Electronic Engineering, 2009, pp. 57-66, vol. 28(1).

Communication dated Jun. 26, 2017 from the Korean Intellectual Property Office in counterpart application No. 10-2016-7007690.

* cited by examiner

| | | Example 1 | Comparative Example 1 |
|---|---|---|---|
| Photomicrograph of Soft Magnetic Layer | |  |  |
| Specific Resistance X $10^{-8}$ (Ωm) | Soft Magnetic Layer | 12.1 | 11.5 |
| | Central Conductor | 3.4 | 2.8 |

HIGH-FREQUENCY WIRE AND HIGH-FREQUENCY COIL

CROSS REFERENCE TO RELATED APPLICATIONS

This application is a National Stage of International Application No. PCT/JP2014/075104, filed on Sep. 22, 2014, which claims priority from Japanese Patent Application No. 2013-198987, filed on Sep. 25, 2013, the contents of all of which are incorporated herein by reference in their entirety.

TECHNICAL FIELD

The present invention relates to a high-frequency wire and a high-frequency coil, and particularly relates to a high-frequency wire and a high-frequency coil which are utilized in winding, a litz wire, a cable, and the like of various types of high-frequency equipment.

Priority is claimed on Japanese Patent Application No. 2013-198987, filed Sep. 25, 2013, the content of which is incorporated herein by reference.

BACKGROUND ART

In winding and feeding cables of equipment (a transformer, a motor, a reactor, an induction heating device, a magnetic head device, and the like) conducting high-frequency currents, an eddy current loss occurs inside a conductor due to a magnetic field caused by the high-frequency current. As a result thereof, there are cases where AC resistance (high-frequency resistance) increases, thereby causing an increase of heat generation and electricity consumption.

As a factor causing the AC resistance to increase, there are a proximity effect and a skin effect.

As illustrated in FIGS. 17A and 17B, the proximity effect is a phenomenon in which an eddy current 53 is generated due to an external magnetic flux 54 and current density J is biased inside a conductor 51.

As illustrated in FIGS. 18A and 18B, the skin effect is a phenomenon in which the current density J becomes high near the surface of the conductor 51 when a conductor current 52 flows in the conductor 51. The eddy current 53 is generated due to an internal magnetic flux 55, and a region where currents flow is restricted. Accordingly, AC resistance increases.

As countermeasures for preventing the proximity effect and the skin effect, generally, the diameter of a wire is reduced and a litz wire in which each element wire is subjected to insulation coating is employed (for example, refer to PTL 1 and PTL 2).

FIGS. 19 and 20 illustrate examples of the element wire of the litz wire (refer to PTL 3).

In an insulation-coated copper wire 30 illustrated in FIG. 19, insulation coating 32 is formed on the external surface of a copper wire 31. In an insulation-coated copper wire 40 illustrated in FIG. 20, a magnetic material plating layer 42 and insulation coating 43 are formed on the external surface of a copper wire 41.

As illustrated in FIG. 21, in the insulation-coated copper wire 40, when an external magnetic field 44 is applied, the magnetic field 44 is distributed in the magnetic material plating layer 42 in a biased manner, and the influence of the magnetic field 44 is reduced in the copper wire 41. Therefore, compared to the insulation-coated copper wire 30 (refer to FIG. 19) having no magnetic material plating layer, it is possible to prevent the proximity effect in a copper wire.

PRIOR ART DOCUMENTS

Patent Documents

[PTL 1] Japanese Unexamined Patent Application, First Publication No. 2009-129550

[PTL 2] Japanese Unexamined Patent Application, First Publication No. 2005-108654

[PTL 3] Japanese Unexamined Patent Application, First Publication No. 2009-277396

DISCLOSURE OF INVENTION

Problem to be Solved by Invention

However, in an insulation-coated copper wire 40, even though the proximity effect in a copper wire 41 is prevented, an eddy current is sometimes generated in a magnetic material plating layer 42, thereby causing a proximity effect loss due to the eddy current. Therefore, the proximity effect is required to be reduced further.

The present invention has been made in consideration of the above-referenced circumstances, and an object thereof is to provide a high-frequency wire and a high-frequency coil in which the proximity effect can be reduced further.

Means for Solving the Problem

A high-frequency wire according to a first aspect of the present invention includes a central conductor that is formed from aluminum or an aluminum alloy, and a magnetic layer that has a fibrous structure formed along a longitudinal direction of the central conductor and covers the central conductor.

It is preferable that the magnetic layer be formed from iron or an iron alloy.

It is preferable that volume resistivity of the magnetic layer be higher than volume resistivity of the central conductor.

It is preferable that the magnetic layer include an insulation coating layer on an outer surface side.

A litz wire according to a second aspect of the present invention includes a plurality of the twisted high-frequency wires.

A high-frequency coil according to a third aspect of the present invention includes the high-frequency wire.

A method of manufacturing a high-frequency wire according to a fourth aspect of the present invention, the method includes drawing a wire base material including a central conductor which is formed from aluminum or an aluminum alloy and a magnetic layer which covers the central conductor by using one or a plurality of dies, thereby obtaining the high-frequency wire in which the magnetic layer has a fibrous structure.

It is preferable that a cumulative reduction rate of area when the wire base material is subjected to wire drawing be equal to or greater than 70%.

Effects of the Invention

According to the aspects of the present invention, the magnetic layer has the fibrous structure formed along the longitudinal direction of the central conductor. Therefore, resistivity in the magnetic layer is high. Accordingly, it is possible to prevent the eddy current and to reduce the proximity effect.

EMBODIMENTS FOR CARRYING OUT THE INVENTION

Hereinafter, embodiments of the present invention will be described with reference to the drawings.

(High-Frequency Wire)

Figure 1:
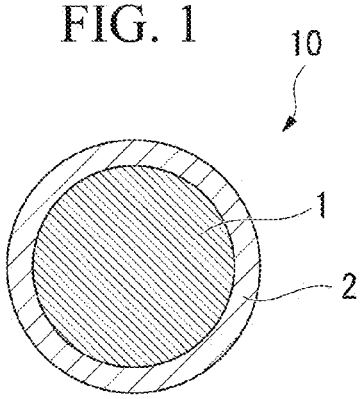
FIG. 1 is a cross-sectional view illustrating a high-frequency wire of an embodiment of the present invention.

FIG. 1 illustrates a high-frequency wire 10 of an embodiment of the present invention. The high-frequency wire 10 includes a central conductor 1 which is formed from aluminum (Al) or an aluminum alloy and a soft magnetic layer 2 (magnetic layer) which covers the central conductor 1.

As the central conductor 1, for example, it is possible to use aluminum for electric use (EC aluminum), an Al—Mg—Si-based alloy (within JIS 6000 to 6999), and the like.

Generally, an aluminum alloy is suitably adopted due to volume resistivity greater than that of EC aluminum.

As the soft magnetic layer 2, it is possible to use iron, an iron alloy, nickel, a nickel alloy, and the like.

As the iron alloy, it is possible to exemplify a FeSi-based alloy (FeSiAl, FeSiAlCr, and the like), a FeAl-based alloy (FeAl, FeAlSi, FeAlSiCr. FeAlO, and the like), a FeCo based-alloy (FeCo, FeCoB, FeCoV, and the like), a FeNi-based alloy (FeNi, FeNiMo, FeNiCr, FeNiSi, and the like) (such as Permalloy (registered trademark)), a FeTa-based alloy (FeTa, FeTaC, FeTaN, and the like), a FeMg-based alloy (FeMgO and the like), a FeZr-based alloy (FeZrNb, FeZrN, and the like), a FeC-based alloy, a FeN-based alloy, a FeP-based alloy, a FeNb-based alloy, a FeHf-based alloy, a FeB-based alloy, and the like.

Figure 21:
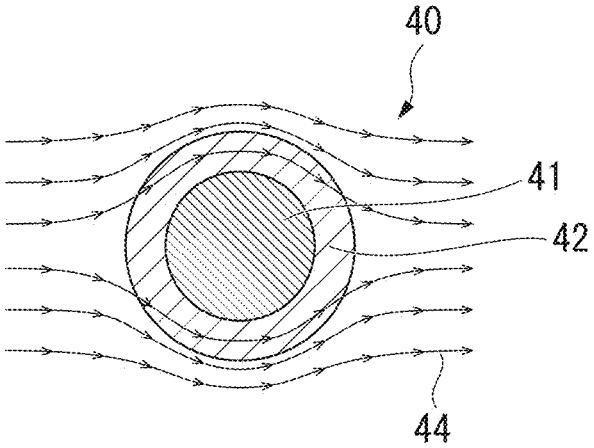
FIG. 21 is a schematic view illustrating distribution of a magnetic field with respect to the high-frequency wire in FIG. 20.

The soft magnetic layer 2 prevents an eddy current by preventing a magnetic field from entering the central conductor 1 (refer to FIG. 21).

For example, it is possible to set relative permeability of the soft magnetic layer 2 to equal to or greater than 10 (for example, 10 to 500).

For example, it is possible to set the thickness of the soft magnetic layer 2 to a range from 1 μm to 1000 μm.

The magnetic layer according to the present invention is not limited to a layer exhibiting so-called "soft magnetism".

It is desirable that the cross-sectional area of the soft magnetic layer 2 be equal to or less than 20% with respect to the cross-sectional area of the entire high-frequency wire 10 in which the central conductor 1 and the soft magnetic layer 2 are added together.

The above-referenced cross-sectional area ratio (the cross-sectional area ratio of the soft magnetic layer 2 with respect to the entire high-frequency wire 10) desirably ranges from 3% to 15%, more desirably ranges from 3% to 10%, and still more desirably ranges from 3% to 5%. It is possible to reduce high-frequency resistance by setting the ratio of the cross-sectional area of the soft magnetic layer 2 with respect to the entire high-frequency wire to the aforementioned range.

For example, the diameter of the entire high-frequency wire 10 can range from 0.05 mm to 0.6 mm.

The soft magnetic layer 2 has a fibrous structure formed along the longitudinal direction of the central conductor 1.

It is possible to determine whether or not "the soft magnetic layer 2 has the fibrous structure" as mentioned above based on the fact that a plurality of granular bodies (for example, crystal grains) each of which the aspect ratio is greater than 5:1 can be confirmed when the structure of the soft magnetic layer 2 is observed by using an electron microscope or the like.

Measurement of the aspect ratio will be described with reference to FIGS. 7A to 11.

Figure 7A:
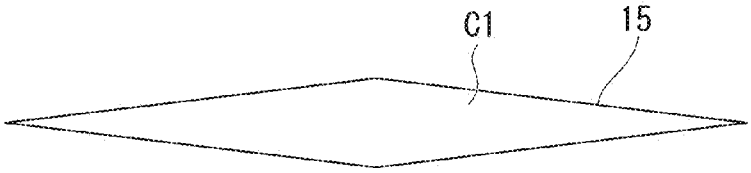
FIG. 7A is a diagram describing a calculation method of an aspect ratio.
Figure 7B:
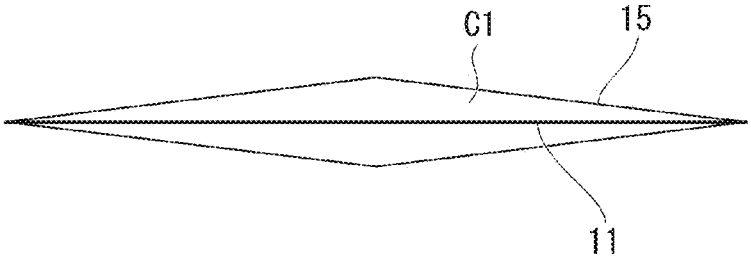
FIG. 7B is another diagram describing the calculation method of the aspect ratio.

As illustrated in FIG. 7B, an auxiliary line 11, which is the longest diameter, is drawn in a crystal grain C1 illustrated in FIG. 7A. Continuously, as illustrated in FIG. 7C, a rectangle 14 having a pair of long sides 12 parallel to the auxiliary line 11 and a pair of short sides 13 perpendicular to the auxiliary line 11 is depicted.

Figure 7C:
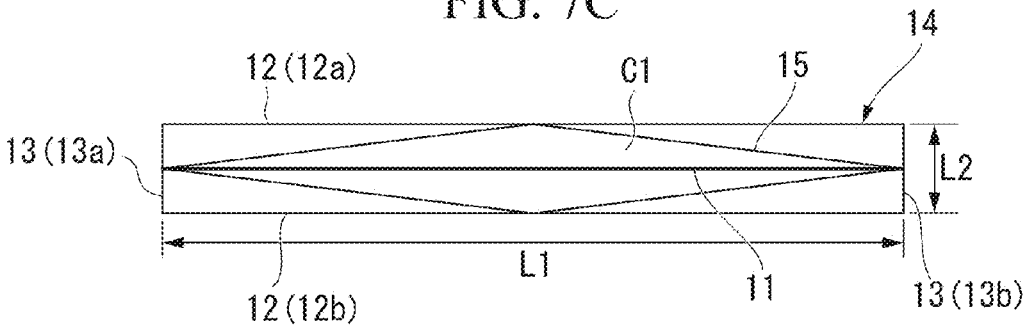
FIG. 7C is further another diagram describing the calculation method of the aspect ratio.

One long side 12 (12*a*) comes into contact with a contour line 15 of the crystal grain C1 at a position farthest from the auxiliary line 11 toward the one side (top in FIG. 7C), and the other long side 12 (12*b*) comes into contact with the contour line 15 of the crystal grain C1 at a position farthest from the auxiliary line 11 toward the other side (bottom in FIG. 7C).

One short side 13 (13*a*) comes into contact with the contour line 15 of the crystal grain C1 at a position farthest from the auxiliary line 11 toward the one side (left in FIG. 7C), and the other short side 13 (13*b*) comes into contact with the contour line 15 of the crystal grain C1 at a position farthest from the auxiliary line 11 toward the other side (right in FIG. 7C).

The ratio of the long side 12 and the short side 13 (L1/L2) in the rectangle 14 is referred to as the aspect ratio. The aspect ratio of the crystal grain C1 in FIG. 7C is 8.32/1.

Figure 8:
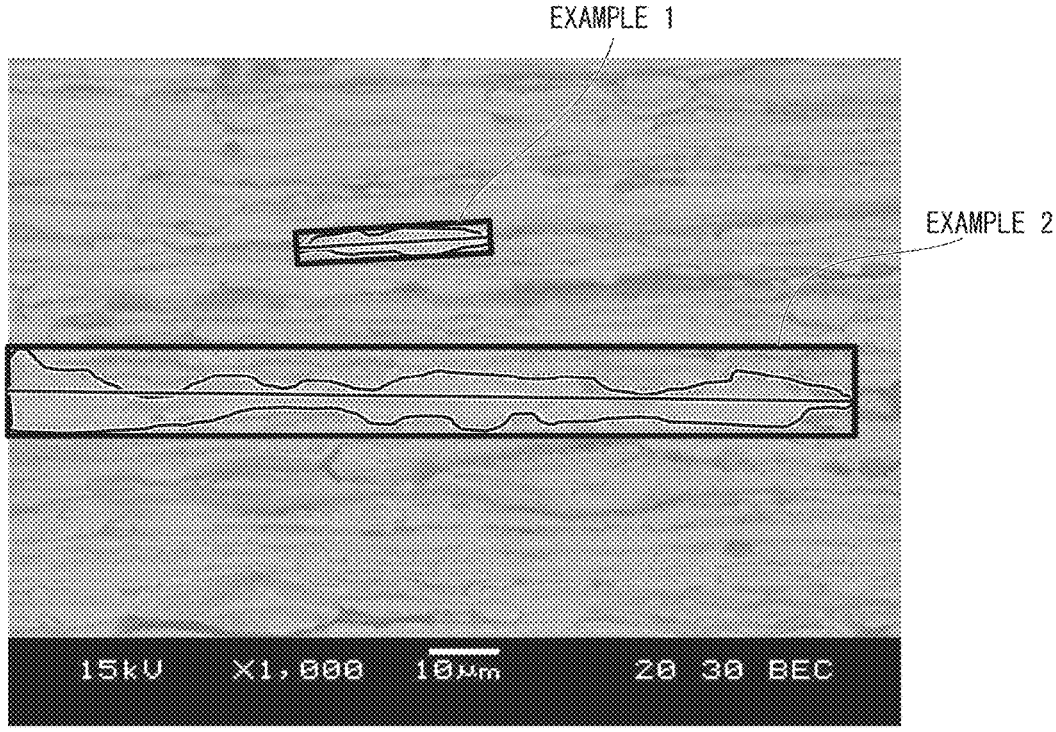
FIG. 8 is a photograph captured by the scanning electron microscope (SEM) showing the soft magnetic layer of the high-frequency wire in Example.
Figure 9:
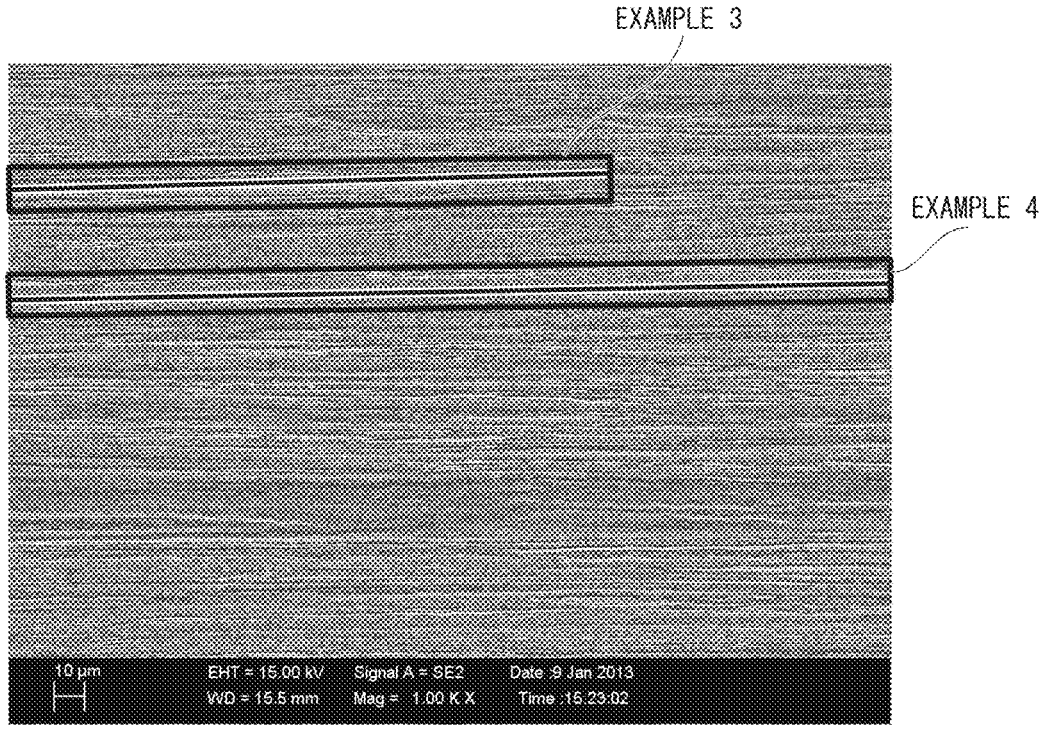
FIG. 9 is another photograph captured by the scanning electron microscope (SEM) showing the soft magnetic layer of the high-frequency wire in Example.

FIGS. 8 and 9 illustrate photographs captured by a scanning electron microscope (SEM) showing the iron-made soft magnetic layer 2 of the high-frequency wire 10.

In FIG. 8, regarding two crystal grains (examples 1 and 2), rectangles are depicted by the above-described technique (refer to the rectangle 14 in FIG. 7C). The aspect ratios of the examples 1 and 2 are respectively "6.1/1" and "9.0/1".

In FIG. 9, regarding two crystal grains (examples 3 and 4), rectangles are depicted by the above-described technique, and the aspect ratios of the examples 3 and 4 are respectively "13.3/1" and "21.2/1".

All the crystal grains of the examples 1 to 4 are formed along the longitudinal direction of the high-frequency wire 10.

In FIGS. 8 and 9, it is possible to confirm a plurality of the crystal grains of iron of which the aspect ratio is greater than 5:1. Accordingly, it is possible to determine that the soft magnetic layer 2 has the fibrous structure formed along the longitudinal direction of the high-frequency wire 10.

When determining whether or not the soft magnetic layer 2 has the fibrous structure, it is desirable that the number of granular bodies which can be confirmed within the visual field of a target photomicrograph be equal to or less than a predetermined number (for example, 100).

As described below, it is preferable that the structure of the soft magnetic layer 2 be a processed structure formed through wire-drawing processing by using a die. For example, the processed structure is a structure after being subjected to cold working.

The cold working denotes processing performed at a temperature lower than the recrystallization temperature.

The fibrous structure may be a structure obtained by stretching the crystal grain in a wire-drawing direction through the wire-drawing processing.

Figure 10:
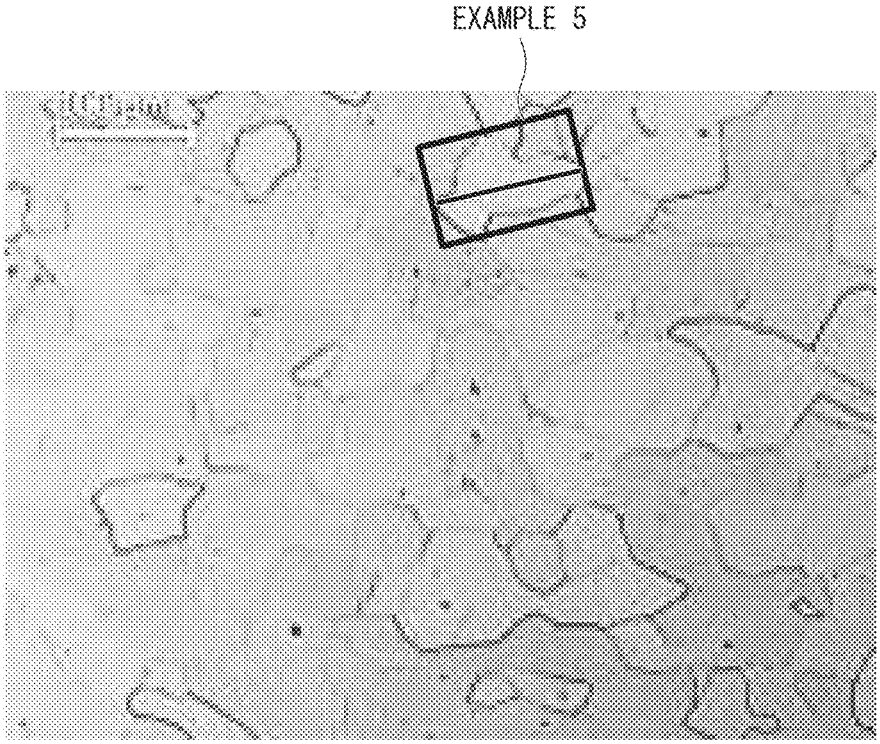
FIG. 10 is an optical photograph captured by an optical microscope showing the soft magnetic layer of the high-frequency wire in Comparative Example.
Figure 11:
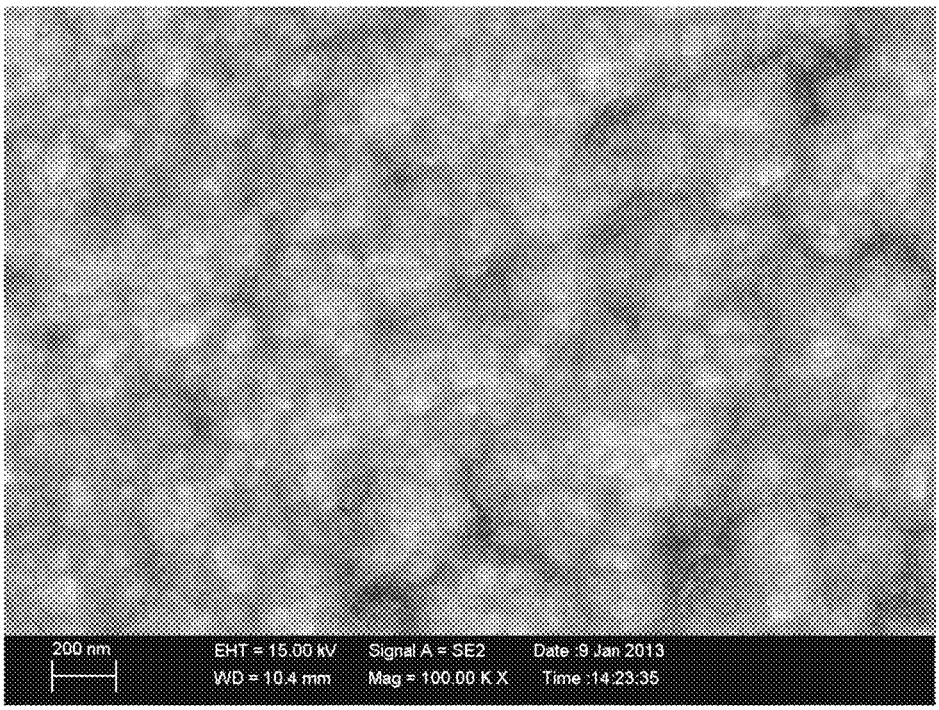
FIG. 11 is a photograph captured by the scanning electron microscope (SEM) showing the soft magnetic layer of the high-frequency wire in Comparative Example.

For comparison, FIG. 10 illustrates a photograph captured by an optical microscope showing the iron-made soft magnetic layer of the high-frequency wire which is subjected to heat treatment (annealing treatment) at a temperature equal to or higher than the recrystallization temperature and is recrystallized. In addition, FIG. 11 illustrates a photograph captured by the scanning electron microscope (SEM) showing a nickel layer on the iron-made soft magnetic layer formed by a plating method.

The above-referenced high-frequency wires include the iron-made soft magnetic layer (refer to FIG. 1). However, the soft magnetic layer has a recrystallized structure obtained by performing heat treatment at a temperature equal to or higher than the recrystallization temperature and performing recrystallization, or a plated structure.

For example, the recrystallized structure is a structure obtained by causing a crystal grain in which deformation has occurred due to cold working to be replaced with a crystal having no deformation by performing recrystallization.

The plated structure is a metal structure formed through wet plating. The plated structure may be amorphous.

In FIG. 10, the crystal grain of which the aspect ratio is greater than 5:1 is not observed. When the aspect ratio of the crystal grain (example 5) is measured, the result is "1.5/1".

In FIG. 11 as well, the crystal grain of which the aspect ratio is greater than 5:1 is not observed.

In FIGS. 10 and 11, the crystal grain of which the aspect ratio is greater than 5:1 cannot be confirmed. Therefore, it is possible to mention that the soft magnetic layers in FIGS. 10 and 11 do not have the fibrous structure.

It is preferable that the volume resistivity of the soft magnetic layer 2 be higher than the volume resistivity of the central conductor 1. Accordingly, it is possible to prevent the AC resistance from increasing due to an eddy current loss.

The fibrous structure formed along the longitudinal direction may be formed not only in the soft magnetic layer 2, but also in the central conductor 1.

In the high-frequency wire 10, an intermetallic compound layer (not illustrated) in which the composition changes obliquely from the central conductor 1 to the soft magnetic layer 2 may be formed between the central conductor 1 and the soft magnetic layer 2. For example, the intermetallic compound layer is formed from an alloy including the constituent material of the central conductor 1 and the constituent material of the soft magnetic layer 2. The intermetallic compound layer may have the volume resistivity greater than that of the soft magnetic layer 2.

Figure 4:
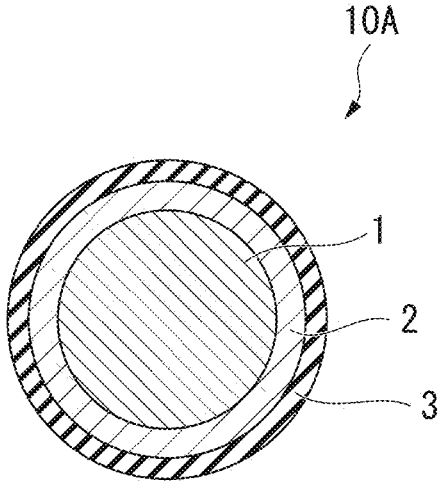
FIG. 4 is a cross-sectional view illustrating the high-frequency wire having an insulation coating layer.

FIG. 4 is Modification Example of the high-frequency wire 10. In a high-frequency wire 10A illustrated therein, an insulation coating layer 3 is provided on the outer surface side of the soft magnetic layer 2. The insulation coating layer 3 is the outermost layer of the high-frequency wire 10A.

The insulation coating layer 3 can be formed by applying enamel coating such as polyester, polyurethane, polyimide, polyester imide, polyamide-imide, and the like.

(Litz Wire)

Figure 12:
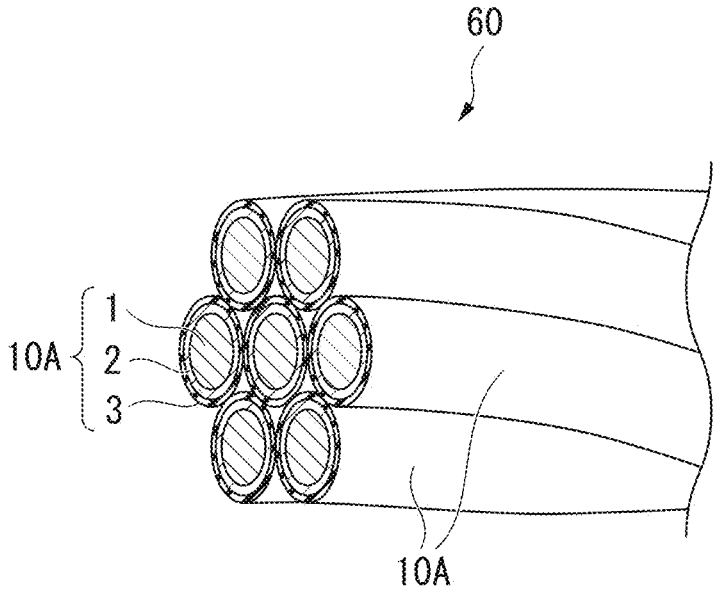
FIG. 12 is a prospective view illustrating an example of a litz wire.

FIG. 12 is an example of a litz wire including the high-frequency wire 10A illustrated in FIG. 4. A litz wire 60 illustrated therein is configured to have a plurality of the high-frequency wires 10A which are bundled and twisted.

(High-Frequency Coil)

Figure 13:
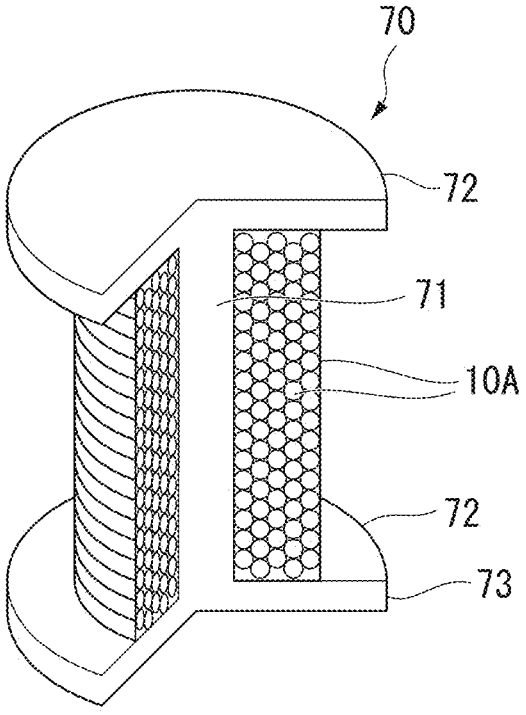
FIG. 13 is a prospective view illustrating an example of a high-frequency coil.
Figure 14:
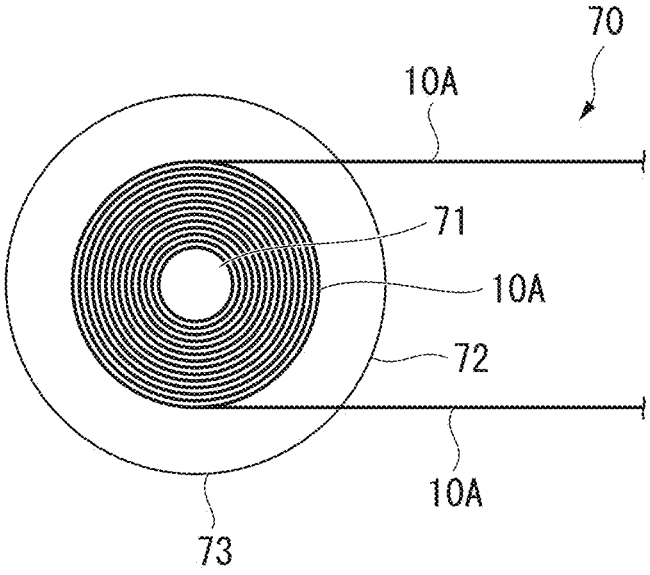
FIG. 14 is another prospective view illustrating an example of the high-frequency coil.

FIGS. 13 and 14 are examples of a high-frequency coil including the high-frequency wires 10A illustrated in FIG. 4. A high-frequency coil 70 illustrated therein adopts a support body 73 having a body portion 71 and flange portions 72 which are formed at both the ends of the body portion 71.

The high-frequency wires 10A are wound around the body portion 71.

(Manufacturing Method of High-Frequency Wire)

<Manufacturing Process of Base Material>

Subsequently, an example of a method of manufacturing the high-frequency wire 10 will be described. The below-described manufacturing method is an example and does not limit the scope of the present invention. The high-frequency wire according to the embodiments of the present invention can also be manufactured by a manufacturing method other than the method exemplified herein.

A central conductor formed from aluminum or an aluminum alloy is prepared. The central conductor is inserted through a tubular soft magnetic layer body. Then, a wire base material having the central conductor and the soft magnetic layer body which surrounds the central conductor is obtained.

The soft magnetic layer body used for manufacturing the wire base material may have a form other than the tubular body.

<Wire-Drawing Process>

Subsequently, the wire base material is subjected to wire drawing by passing through one or a plurality of wire-drawing dies.

Figure 2:
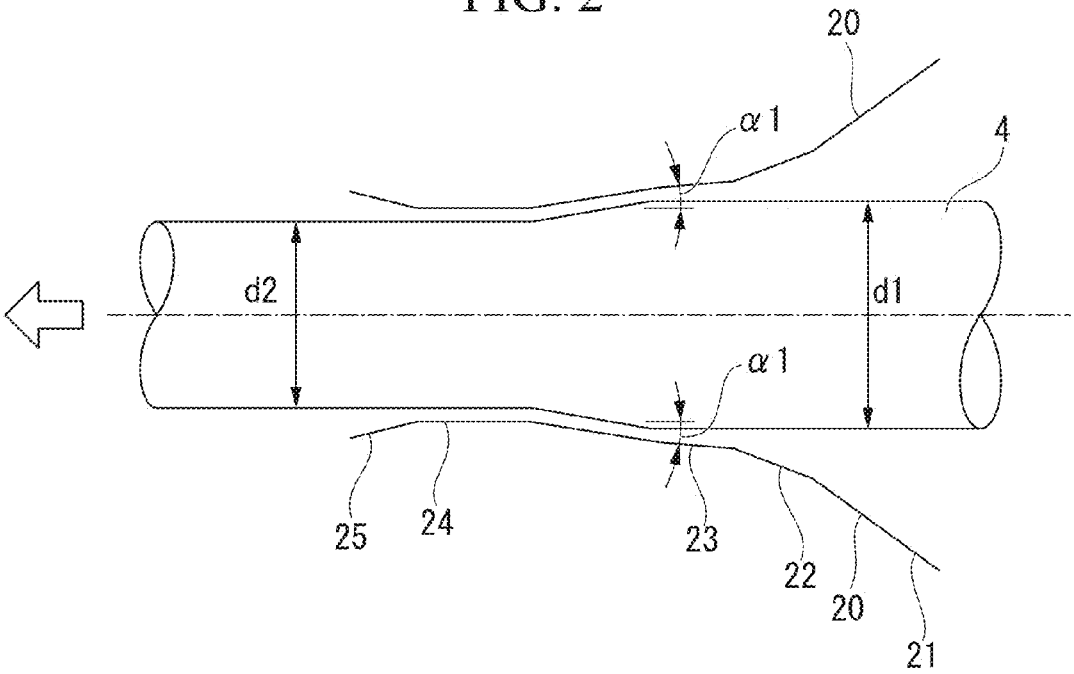
FIG. 2 is a schematic view illustrating an example of a wire-drawing die.

FIG. 2 illustrates a wire-drawing die 20 which can be applied to the manufacturing method of the present embodiment. The wire-drawing die 20 includes an entrance portion 21, an approach portion 22, a reduction portion 23, a bearing portion 24, and a back relief portion 25.

The wire-drawing die 20 is a tubular body of which the inner diameter gradually decreases from the entrance portion 21 to the reduction portion 23.

For example, a reduction angle $\alpha$1 which is the inclination angle of the inner surface of the reduction portion 23 with respect to the central axis can be set to approximately 8°.

The reduction rate of area (the difference between the cross-sectional areas of the wire base material before and after wire drawing/the cross-sectional area of the wire base material before wire drawing) calculated by using the cross-sectional area of the wire base material and the cross-sectional area of the inner space of the bearing portion 24 can be set to equal to or greater than 20%, for example, can be set to a range from 20% to 29%. When the reduction rate of area after one turn of wire drawing is within the aforementioned range, it is possible to consistently generate significant shearing stress in the same direction.

A wire base material 4 is introduced into the reduction portion 23 via the entrance portion 21 and the approach portion 22 and is processed at the reduction portion 23 so as to have a diameter d2 smaller than a diameter d1 before being subjected to wire drawing.

The wire-drawing process may be performed only once. However, the wire-drawing process may be performed several times by using another wire-drawing die 20 having a different inner diameter measurement. In this manner, it is possible to raise the reduction rate of area. For example, it is possible to perform wire drawing in stages by using a plurality of the wire-drawing dies 20.

For example, the cumulative reduction rate of area can be set to be equal to or greater than 70%.

Accordingly, it is possible to reliably and easily form the soft magnetic layer 2 having a fibrous structure formed along the longitudinal direction of the central conductor 1.

In the wire-drawing process in which the wire-drawing die 20 is used, the fibrous structure may be formed not only in the soft magnetic layer 2, but also in the central conductor 1.

In the high-frequency wire 10, the soft magnetic layer 2 has the fibrous structure formed along the longitudinal direction of the central conductor 1, there are plenty of grain boundaries in the magnetic layer, and dislocation density is high. Therefore, resistivity in the soft magnetic layer 2 is high. Accordingly, it is possible to prevent the eddy current from occurring due to an external magnetic field and to reduce the proximity effect.

Figure 3:
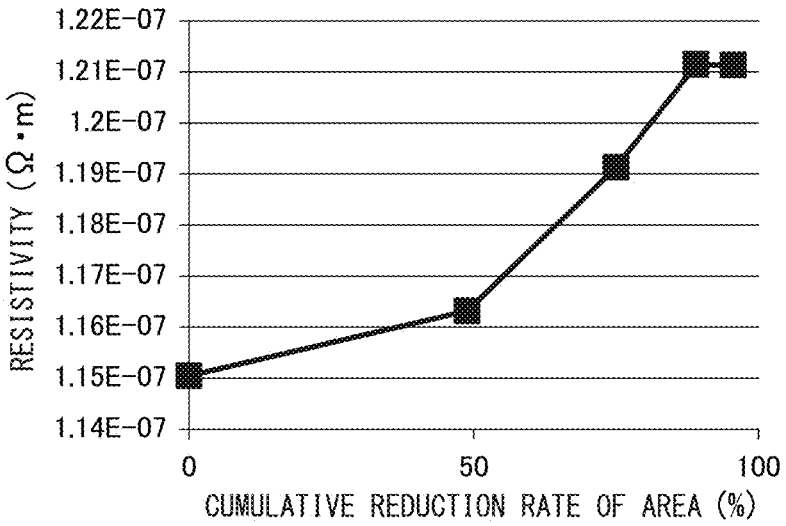
FIG. 3 is a graph illustrating a relationship between a cumulative reduction rate of area and resistivity.

FIG. 3 is a graph illustrating a relationship between the cumulative reduction rate of area and the resistivity of the soft magnetic layer 2. As illustrated in the diagram, when the cumulative reduction rate of area becomes high and a fibrous structure is formed in the soft magnetic layer 2, the resistivity increases.

When the resistivity increases, the eddy current is unlikely to be generated. Therefore, it is considered that the proximity effect is reduced.

In addition, according to the report of the below-referenced literature, as the resistivity of the magnetic layer becomes high, the AC resistance is prevented from increasing due to the eddy current loss.

COMPEL-THE INTERNATIONAL JOURNAL FOR COMPUTATION AND MATHEMATICS IN ELECTRICAL AND ELECTRONIC ENGINEERING 28(1): 57-66 (2009), Mizuno et. al.

In addition, when copper or the like is used for the central conductor in a coil used at high frequencies, the AC loss caused by the proximity effect becomes significant. Meanwhile, in the high-frequency wire 10 of the present embodiment, aluminum (or an aluminum alloy) is used for the central conductor 1. Therefore, compared to a case of using copper or the like for the central conductor 1, it is possible to prevent the influence of the proximity effect.

In a high-frequency wire used in equipment such as a high-frequency transformer, a high-speed motor, a reactor, a dielectric heating device, a magnetic head device, a non-contact feeding device, and the like conducting high-frequency currents in a range approximately from several kHz to several hundred kHz, for the purpose of reducing the AC loss, reduction of the diameter of the winding is attempted, or the litz wire is employed.

However, in soldering treatment performed for the connection, due to reasons such as time and effort taken in work of eliminating the insulation film, limitations of wire drawing, and the like, there is a limit to reduction of diameter.

In contrast, according to the high-frequency wire 10 of the present embodiment, even though a litz wire which includes element wires having thick diameters and a small number of element wires is employed, it is possible to reduce the loss.

EXAMPLE 1

The high-frequency wire 10 illustrated in FIG. 1 was manufactured as follows.

A central conductor formed from aluminum having an outer diameter of 9 mm was inserted through a steel pipe (soft magnetic layer body) having an inner diameter of 10 mm and an outer diameter of 12 mm, and the wire base material 4 was obtained.

As illustrated in FIG. 2, the wire base material 4 was subjected to wire drawing in stages by being caused to pass through the plurality of wire-drawing dies 20. Then, the high-frequency wire 10 which included the soft magnetic layer 2 having the outer diameter of 2.1 mm and the central conductor 1 having the outer diameter of 1.9 mm was obtained.

Figure 5A:
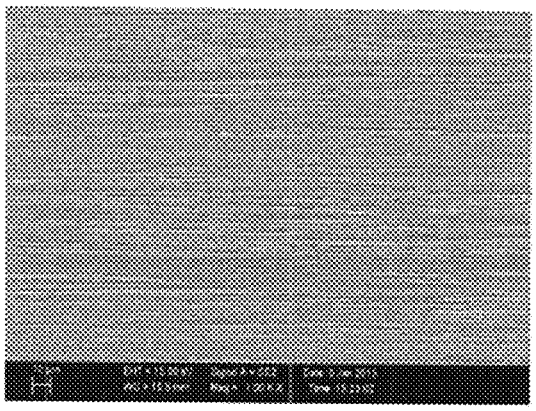
FIG. 5A is a photograph captured by a scanning electron microscope (SEM) showing a soft magnetic layer in Example.
Figure 5B:
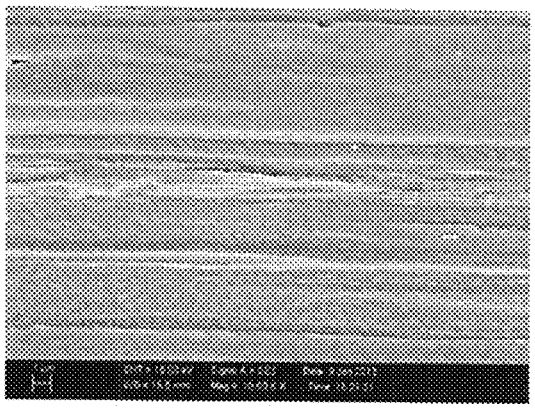
FIG. 5B is an enlarged SEM photograph of FIG. 5A.
Figure 6A:
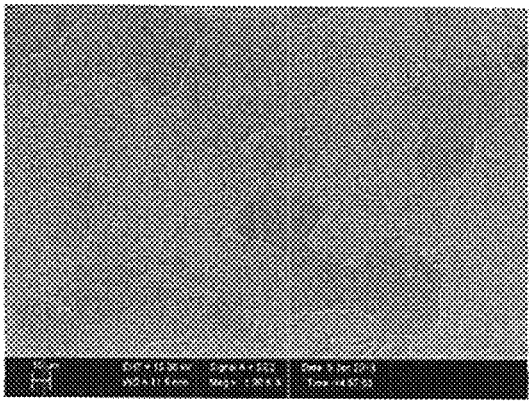
FIG. 6A is a photograph captured by the scanning electron microscope (SEM) showing the soft magnetic layer in Comparative Example.
Figure 6B:
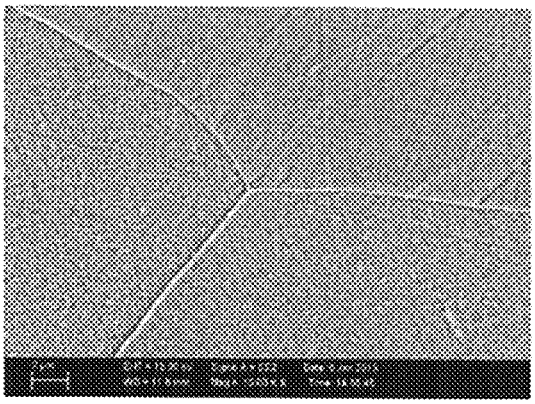
FIG. 6B is an enlarged SEM photograph of FIG. 6A.

FIG. 5A is a photograph captured by the SEM showing the soft magnetic layer 2, and FIG. 5B is an enlarged SEM photograph of FIG. 5A.

With reference to the diagrams, it was possible to confirm a plurality of the crystal grains of which the aspect ratios exceeded "5/1". Therefore, it was confirmed that the soft magnetic layer 2 had the fibrous structure formed along the longitudinal direction of the central conductor 1.

The specific resistance of the central conductor 1 and the soft magnetic layer 2 in the high-frequency wire 10 was calculated as follows.

Figure 22:
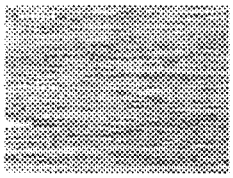
FIG. 22 is a table showing results from Example 1 and Comparative Example 1.
Figure 22:
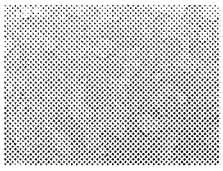

A central conductor in a single body made from the same material as that of the soft magnetic layer 2 of the high-frequency wire 10 was subjected to reduction of area through the wire-drawing process, and the specific resistance thereof was measured. FIG. 22 shows the value thereof as the specific resistance of the soft magnetic layer 2.

Continuously, the specific resistance of the high-frequency wire 10 (composite material) was measured. 1FIG. 22 shows the value obtained by subtracting the above-referenced specific resistance of the soft magnetic layer 2 from the measured value, as the specific resistance of the central conductor 1.

COMPARATIVE EXAMPLE 1

The high-frequency wire including the central conductor formed from aluminum and the iron-made soft magnetic layer was manufactured, and heat treatment was performed at a temperature equal to or higher than the recrystallization temperature of the soft magnetic layer.

No fibrous structure formed along the longitudinal direction was confirmed in the soft magnetic layer.

By applying a technique similar to that in Example 1, the specific resistance of the central conductor and the soft magnetic layer was measured. FIG. 22 shows the results thereof.

According to FIG. 22 in Example 1, compared to Comparative Example 1, it was found that the specific resistance of the soft magnetic layer 2 can be made higher.

EXAMPLE 2

The wire base material 4 obtained in a similar manner as that in Example 1 was subjected to wire drawing in stages by being caused to pass through the plurality of wire-drawing dies 20. Then, the high-frequency wire 10 was obtained. The high-frequency wire 10A illustrated in FIG. 4 was obtained by forming the insulation coating layer 3 on the outer surface of the high-frequency wire 10. The thickness of the soft magnetic layer 2 was 3 μm, the outer diameter of the soft magnetic layer 2 was 126 μm, and the outer diameter of the central conductor 1 was 120 μm.

As illustrated in FIG. 12, the litz wire 60 adopting the high-frequency wires 10A as the element wires was manufactured.

The litz wire 60 was configured to have 1,500 high-frequency wires 10A, and the length of the litz wire 60 was 21 m.

Figure 15:
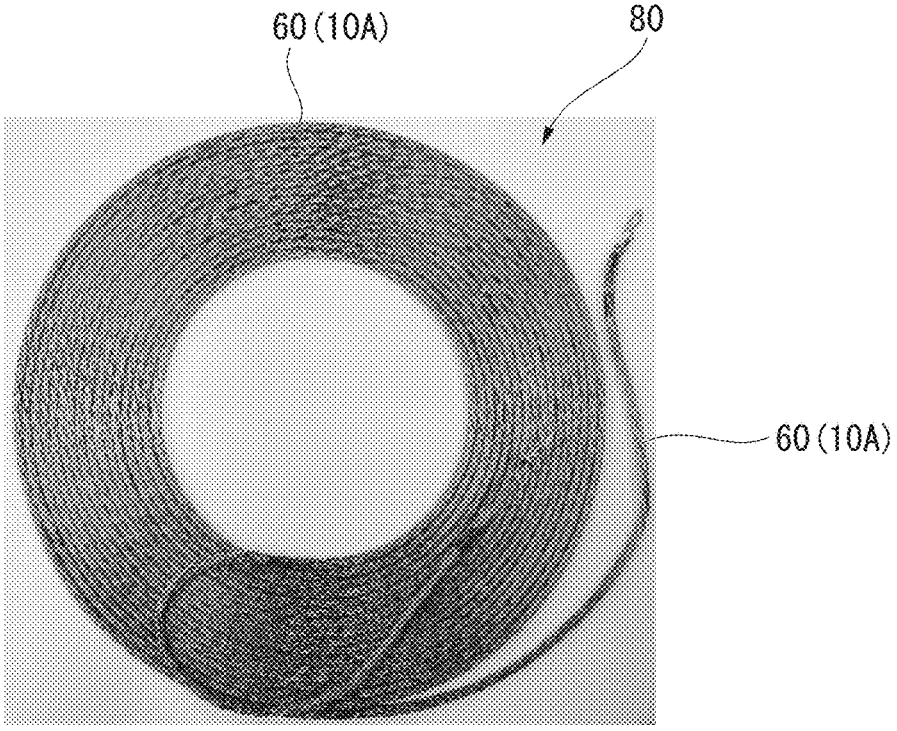
FIG. 15 is a view showing the appearance of an example of a coil.

As illustrated in FIG. 15, a coil 80 was manufactured by using the litz wire 60. The number of turns of the coil 80 was 16. Inductance was $1.18\times10^{-4}$ H.

For example, the AC resistance per unit length of the lead wire configuring the coil can be presented through the following expression (refer to Paragraphs [0041] and [0070] of PCT International Publication No. WO 2013/042671).

$$R_{ac}=R_s+R_p$$

$R_s$ (Ω/m) is the high-frequency resistance per unit length caused by a skin effect, and $R_p$ (α/m) is the high-frequency resistance per unit length caused by the proximity effect. Moreover, $R_p$ is a value proportional to the square of the shape factor α (1/m) indicating the strength of the external magnetic field.

$$R_p=\alpha^2 D_p$$

$D_p$ (Ω·m) indicates the high-frequency loss per unit length caused by the proximity effect.

The shape factor α of the coil 80 in this example is 90 $mm^{-1}$.

Figure 16:
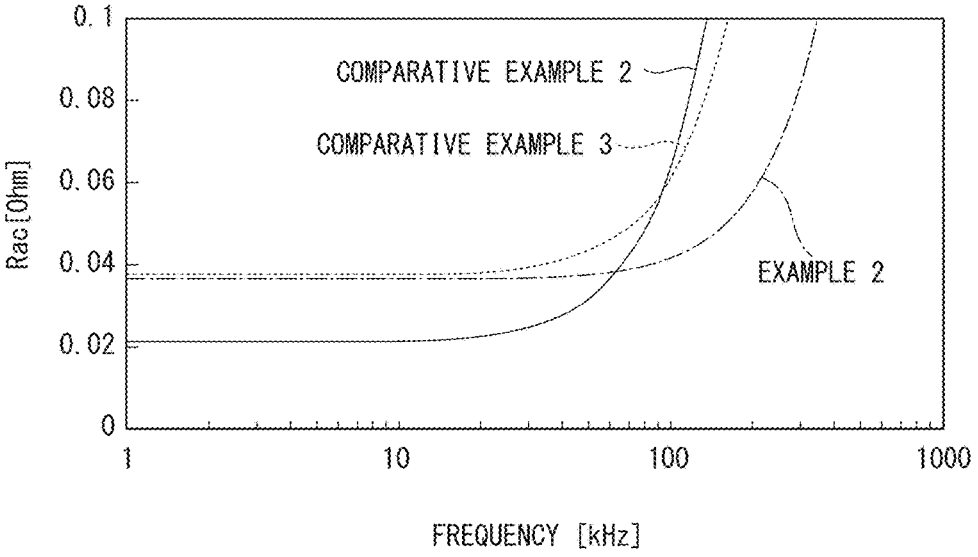
FIG. 16 is a graph illustrating a simulation result regarding a relationship between an AC frequency and AC resistance.
Figure 17A:
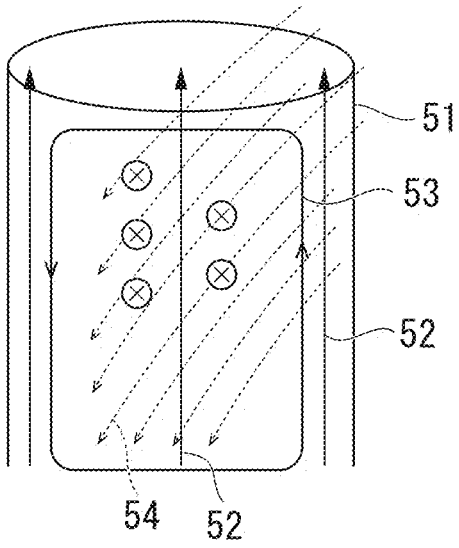
FIG. 17A is a schematic view for describing a proximity effect.
Figure 17B:
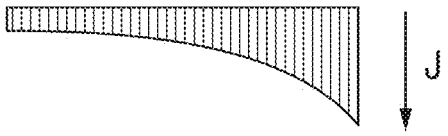
FIG. 17B is another schematic view for describing the proximity effect.
Figure 18A:
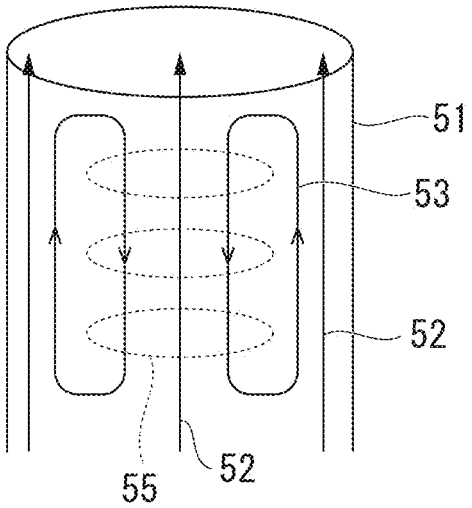
FIG. 18A is a schematic view for describing a skin effect.
Figure 18B:
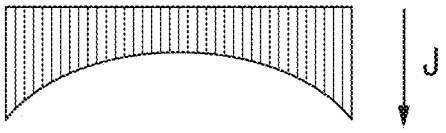
FIG. 18B is another schematic view for describing the skin effect.
Figure 19:
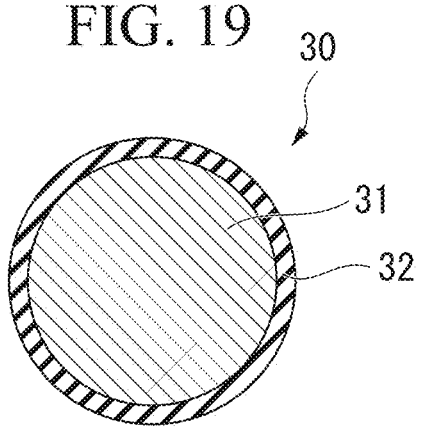
FIG. 19 is a cross-sectional view illustrating an example of the high-frequency wire in the related art.
Figure 20:
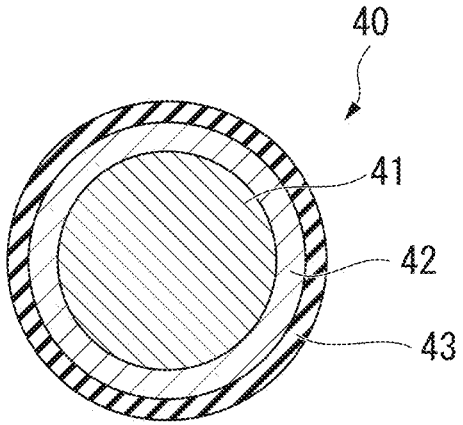
FIG. 20 is a cross-sectional view illustrating another example of the high-frequency wire in the related art.

Regarding the coil 80 in Example 2, FIG. 16 illustrates the simulated result of a relationship between the AC frequency (horizontal axis) and the AC resistance (vertical axis).

COMPARATIVE EXAMPLE 2

The litz wire 60 illustrated in FIG. 12 was manufactured in a manner similar to that in Example 2 except that Cu wires (outer diameter of 120 μm) were adopted in place of the high-frequency wires 10. Then, the coil 80 illustrated in FIG. 15 was manufactured by using this litz wire 60. Other specifications were similar to those in Example 2.

Regarding the coil 80 in Comparative Example 2, FIG. 16 illustrates the simulated result of a relationship between the AC frequency and the AC resistance.

COMPARATIVE EXAMPLE 3

The litz wire 60 illustrated in FIG. 12 was manufactured in a manner similar to that in Example 2 except that Al wires (outer diameter of 120 μm) were adopted in place of the high-frequency wires 10. Then, the coil 80 illustrated in FIG. 15 was manufactured by using this litz wire 60. Other specifications were similar to those in Example 2.

Regarding the coil 80 in Comparative Example 3, FIG. 16 illustrates the simulated result of a relationship between the AC frequency and the AC resistance.

As illustrated in FIG. 16, in Example 2 in which the high-frequency wire 10 having the central conductor 1 formed from Al and the soft magnetic layer 2 including Fe was adopted, compared to Comparative Examples 2 and 3 in which Cu wires and Al wires were adopted, it was possible to obtain a result in which the AC resistance was reduced in the frequency band equal to or higher than 70 kHz.

The above-described embodiments have exemplified a device and a method in order to realize the technical ideas of the invention. Therefore, in the technical ideas of the invention, the material properties, the shapes, the structures, the arrangements, and the like of the configurational components are not specified.

INDUSTRIAL APPLICABILITY

A high-frequency wire and a high-frequency coil of the present invention can be utilized in the electronic equipment industry including the industry of manufacturing various devices such as a non-contact feeding device, a high-frequency current generation device, and the like including a high-frequency transformer, a motor, a reactor, a choke coil, an induction heating device, a magnetic head, a high-frequency feeding cable, a DC power unit, a switching power source, an AC adapter, eddy current detection-type displacement sensor/flaw sensor, an 1I cooking heater, a coil, a feeding cable, and the like.

DESCRIPTION OF THE REFERENCE NUMERALS

1 CENTRAL CONDUCTOR, 2 SOFT MAGNETIC LAYER (MAGNETIC LAYER), 10 HIGH-FREQUENCY WIRE, 60 LITZ WIRE, AND 70 HIGH-FREQUENCY COIL

The invention claimed is:

1. A high-frequency wire, comprising:

a central conductor that is formed from aluminum or an aluminum alloy; and a soft magnetic layer that has a fibrous structure including a crystal grain and formed along a longitudinal direction of the central conductor and covers the central conductor, the soft magnetic layer being formed from iron or an iron alloy.

2. The high-frequency wire according to claim 1, wherein the soft magnetic layer includes an insulation coating layer on an outer surface side.

3. A litz wire, comprising:

a plurality of the twisted high-frequency wires according to claim 1.

4. A high-frequency coil, comprising:

the high-frequency wire according to claim 1.

5. A method of manufacturing the high-frequency wire according to claim 1, comprising drawing a wire base material including a central conductor which is formed from aluminum or an aluminum alloy and a soft magnetic layer which covers the central conductor by using one or a plurality of dies, thereby obtaining the high-frequency wire in which the soft magnetic layer has a fibrous structure, the soft magnetic layer being formed from iron or an iron alloy.

6. The method of manufacturing a high-frequency wire according to claim 5, wherein a cumulative reduction rate of area when the wire base material is subjected to wire drawing is equal to or greater than 70%.

7. The method of manufacturing a high-frequency wire according to claim 5, wherein the wire base material is obtained by inserting the central conductor through a tubular soft magnetic layer body made of the soft magnetic layer.

8. The method of manufacturing a high-frequency wire according to claim 5, wherein the fibrous structure is formed by drawing the wire base material at a temperature lower than the recrystallization temperature of the soft magnetic layer.

9. The high-frequency wire according to claim 1, wherein the crystal grain has an aspect ratio greater than 5:1.

10. The high-frequency wire according to claim 1, wherein a cross-sectional area of the soft magnetic layer is equal to or less than 20% with respect to that of the entire high-frequency wire.

11. The high-frequency wire according to claim 1, wherein the fibrous structure is formed also in the central conductor along a longitudinal direction of the central conductor.

* * * * *